US010119425B2

(12) United States Patent
Young et al.

(10) Patent No.: US 10,119,425 B2
(45) Date of Patent: Nov. 6, 2018

(54) GAS TURBINE ENGINE ROTOR ARRANGEMENT

(71) Applicant: ROLLS-ROYCE PLC, London (GB)

(72) Inventors: Colin Young, Derby (GB); Guy D Snowsill, Derby (GB)

(73) Assignee: ROLLS-ROYCE plc, London (GB)

( * ) Notice: Subject to any disclaimer, the term of this patent is extended or adjusted under 35 U.S.C. 154(b) by 299 days.

(21) Appl. No.: 14/827,870

(22) Filed: Aug. 17, 2015

(65) Prior Publication Data

US 2016/0061058 A1 Mar. 3, 2016

(30) Foreign Application Priority Data

Aug. 29, 2014 (GB) ..... 1415280.5

(51) Int. Cl.
*F01D 5/30* (2006.01)
*F01D 25/32* (2006.01)
*F01D 5/08* (2006.01)

(52) U.S. Cl.
CPC ..... *F01D 25/32* (2013.01); *F01D 5/3007* (2013.01); *F01D 5/081* (2013.01); *F01D 5/082* (2013.01); *F01D 5/084* (2013.01); *F05D 2260/607* (2013.01)

(58) Field of Classification Search
CPC ..... F01D 5/3007; F01D 5/081; F01D 5/082; F01D 25/32; F01D 5/084
See application file for complete search history.

(56) References Cited

U.S. PATENT DOCUMENTS

| | | | | |
|---|---|---|---|---|
| 3,045,968 A | | 7/1962 | Willis | |
| 5,062,768 A | | 11/1991 | Marriage | |
| 5,476,364 A | | 12/1995 | Kildea | |
| 5,624,233 A | * | 4/1997 | King | F01D 5/02 416/213 R |
| 6,065,938 A | * | 5/2000 | Bartsch | F01D 5/30 416/219 R |
| 2005/0002778 A1 | | 1/2005 | Fried et al. | |

(Continued)

FOREIGN PATENT DOCUMENTS

| | | |
|---|---|---|
| CN | 202370590 U | 8/2012 |
| EP | 1 136 654 A1 | 9/2001 |

(Continued)

OTHER PUBLICATIONS

Mar. 5, 2015 Search Report issued in British Application No. GB1415280.5.

*Primary Examiner* — Jason Shanske
*Assistant Examiner* — Behnoush Haghighian
(74) *Attorney, Agent, or Firm* — Oliff PLC

(57) ABSTRACT

A gas turbine engine rotor arrangement comprising at least one blade and a disc is disclosed. The blade extends radially outwards from the disc and is secured thereto by cooperating shank of the blade and recess of the disc. The shank comprises a bottom surface facing a base surface of the recess, the bottom surface having axially extending peripheral edges. The bottom surface is shaped so that when the engine rotor arrangement is in use, liquid in a cavity between the bottom surface and base surface, acted upon by an unbalanced force in the radially outward direction, is guided by the bottom surface to flow between and away from the axial edges.

10 Claims, 3 Drawing Sheets

(56) References Cited

U.S. PATENT DOCUMENTS

| | | | | |
|---|---|---|---|---|
| 2006/0275125 | A1* | 12/2006 | Bibor | F01D 5/081 416/193 A |
| 2009/0180886 | A1 | 7/2009 | Derclaye et al. | |
| 2016/0017727 | A1* | 1/2016 | Whitehurst | F01D 5/3007 416/219 A |

FOREIGN PATENT DOCUMENTS

| | | | |
|---|---|---|---|
| EP | 2 388 193 | A2 | 11/2011 |
| EP | 2 639 407 | A1 | 9/2013 |
| GB | 2 095 765 | A | 10/1982 |

* cited by examiner

GAS TURBINE ENGINE ROTOR ARRANGEMENT

The present disclosure concerns a gas turbine engine rotor arrangement, a blade and a gas turbine engine. More specifically the disclosure concerns the management of liquid in the so called 'bucket groove' between a bottom surface of a blade shank and a base surface of a corresponding recess in a disc in which the shank is secured.

A bucket groove (cavity) may be provided between the bottom surface of a blade and the base surface of a recess in a disc used to retain the blade. The bucket groove may be provided to allow cooling air to reach an inlet through the bottom surface of the blade for supplying cooling passages within the body of the blade. The bucket groove may also allow cooling fluid to pass from an upstream to a downstream side of the blade for cooling purposes. The cooling fluid may be bled from a compressor stage of the gas turbine engine and supplied to the bucket groove. Unfortunately however the cooling fluid may introduce unwanted liquid contaminants (such as oil) into the bucket groove.

Liquid contaminants in the bucket groove tend to be incident on the bottom surface of the blade shank under the influence of the centrifugal force generated by rotation of the rotor. Accumulations tend to occur at or adjacent axially extending peripheral edges of the bottom surface. This may especially be the case where (as is typical) the bottom surface has a shape that compliments the base of the cooperating recess. Pooling or uncontrolled flows of liquid contaminant such as oil may be hazardous, potentially unbalancing rotations, accelerating corrosion or presenting a fire risk.

Furthermore a film of liquid contaminant may form on the bottom surface under the influence of the centrifugal force. This contaminant may flow axially across the surface eventually exiting in front of or at the rear of the rotor. With existing designs it is uncertain in which direction the liquid contaminant will flow under the influence of the centrifugal force making it more difficult to manage its safe disposal.

Potential solutions to these problems considered include increasing the quantity of cooling fluid flow in order to entrain the liquid contaminant and drain it to an annulus of the gas turbine engine. This would however give rise to efficiency losses, increases the quantity of cooling fluid that must be bled from the compressor stage.

According to a first aspect of the invention there is provided a gas turbine engine rotor arrangement comprising optionally at least one blade and optionally a disc, the blade optionally extending radially outwards from the disc and optionally secured thereto by cooperating shank of the blade and recess of the disc, the shank optionally comprising a bottom surface facing a base surface of the recess, the bottom surface optionally having axially extending peripheral edges and optionally being shaped so that when the engine rotor arrangement is in use, liquid in a cavity between the bottom surface and base surface, acted upon by an unbalanced force in the radially outward direction, is guided by the bottom surface to flow between and away from the axial edges. In this way liquid pooling or flow at or adjacent the axially extending edges may be reduced.

Unless otherwise stated, the term axial used in this specification refers to a direction parallel to the main axis of rotation of a gas turbine engine in which the rotor arrangement would be located in use. Similarly radial refers to directions perpendicular to the axial direction.

In some embodiments the bottom surface meets a wall of the recess along each axial edge. This may reduce the likelihood of liquid flowing between the shank and recess.

In some embodiments the bottom surface is dished or channeled to direct liquid flow away from the axial edges. The bottom surface might for example have a concave cross-sectional shape or a substantially 'V' or 'U' shaped cross-sectional shape.

In some embodiments the cross-sectional shape and size may be substantially maintained throughout the axial extent of the bottom surface. This may allow liquid to flow out of the cavity between the bottom surface and base surfaces to the front or rear of the rotor. In alternative embodiments the cross-sectional shape and/or size may change in the axial direction of the bottom surface. It may be for example that the bottom surface is shaped to form a concave dish tending to direct liquid towards the centre of the bottom surface under the influence of the centrifugal force. Where present the liquid may then flow into a cooling fluid inlet through the bottom surface, into the body of the blade and out through cooling holes, whereupon it may be safely dispersed in a main annulus of the gas turbine engine.

In some embodiments the bottom surface has peripheral circumferentially extending edges, one at the front of the rotor and at the rear, the circumferential edges having in use different radial distances from the axis of rotation of the rotor arrangement. This may mean that any liquid pooling in or flowing adjacent the bottom surface will tend to leave the cavity between the bottom surface and the base surface in a predictable axial direction (either forward or backwards) beyond the circumferential edge having the greater radial distance from the axis of rotation of the rotor arrangement. In view of the predictability of the liquid flow direction, it may be possible to provide drainage to the front or rear of the rotor only. Providing drainage to one side of the rotor only may reduce weight and complexity and increase design freedom.

In some embodiments the front circumferential edge has a greater radial distance from the axis of rotation of the rotor than the rear circumferential edge. This may be advantageous, especially where, as is often the case, a lockplate is provided to the rear of the shank that would prevent liquid from leaving the cavity to the rear. Alternatively the rear circumferential edge may have a greater radial distance from the axis of rotation of the rotor than the front circumferential edge, especially if a lockplate is provided to the front of the shank.

In some embodiments the bottom surface is sloped in the axial direction. This may mean that under the influence of circumferential force, liquid in the cavity will flow energetically down the slope towards the circumferential edge at the bottom of the slope. This may reduce liquid dwell time in the cavity and mean that the axial direction of liquid exit from the cavity is predictable. As will be appreciated the sloping of the bottom surface may be simple, e.g. a single slope that extends downwards from one of the circumferential edges to the other circumferential edge. This may be advantageous where it is desirable that liquid exits to one of the front and the rear of the rotor only. Alternatively the sloping may be compound i.e. two slopes, one extending downwards towards one of the circumferential edges and the other extending downwards towards the other of the circumferential edges. This may be advantageous where liquid exit to either the front or rear of the rotor is acceptable and it is simply desired to reduce the dwell time by increasing the liquid flow rate out of the cavity.

In some embodiments the slope is at least any one of 1°, 2°, 3°, 4° or 5°.

In some embodiments the bottom surface slopes radially outwards in a direction from a rear of the disc to a front of the disc. In alternative embodiments however the slope may be radially outwards in a direction from a front of the disc to a rear of the disc.

In some embodiments the gas turbine engine rotor arrangement is a turbine.

According to a second aspect of the invention there is provided a blade in accordance with the first aspect.

According to a third aspect of the invention there is provided a gas turbine engine having a rotor arrangement in accordance with the first aspect.

The skilled person will appreciate that a feature described in relation to any one of the above aspects of the invention may be applied mutatis mutandis to any other aspect of the invention.

Embodiments of the invention will now be described by way of example only, with reference to the FIGS., in which.

Figure 1:
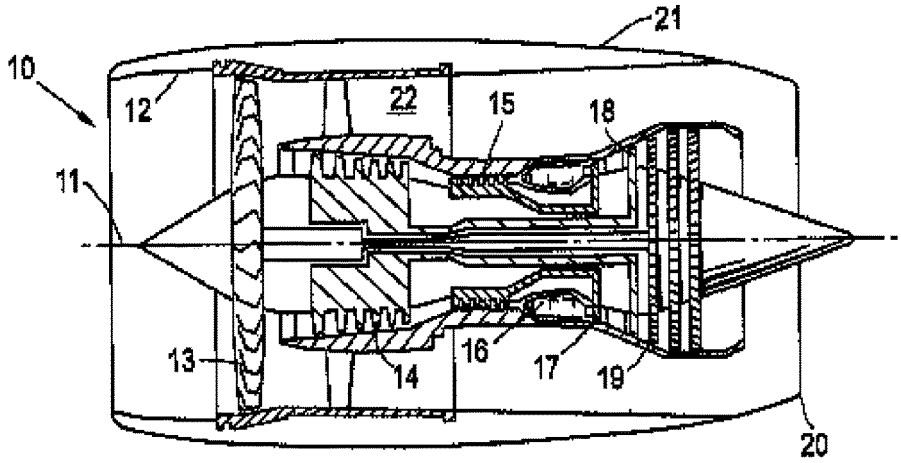
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Figure 2:
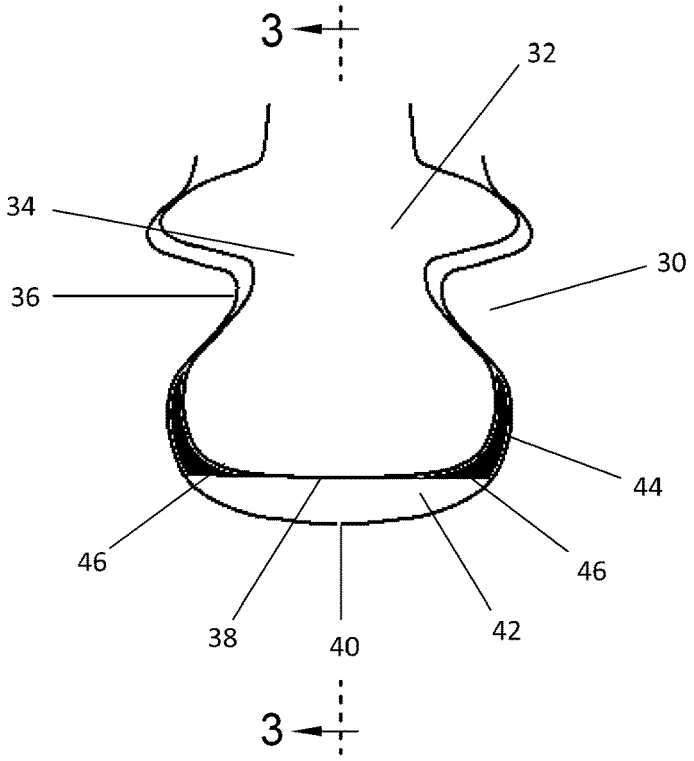
FIG. 2 RELATED ART
FIG. 2 is an axial cross-section through the shank and corresponding recess of a prior art gas turbine engine rotor arrangement.
Figure 3:
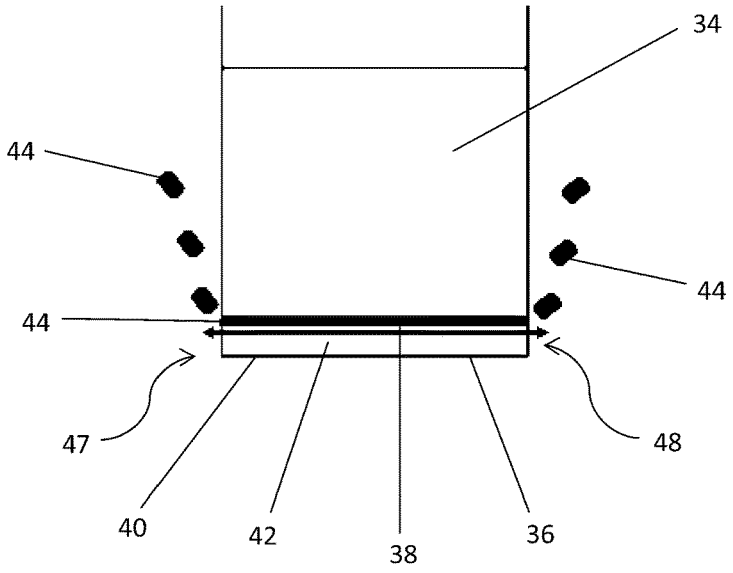
FIG. 3 RELATED ART
FIG. 3 is a radial cross-section through the shank and corresponding recess of FIG. 2.

Each of the compressors 14 and 15 and turbines 17, 18 and 19 comprises one or more rotor arrangements each having a disc with a number of blades extending radially outwards therefrom. Referring now to FIGS. 2 and 3, part of a typical disc 30 and blade 32 is shown. The blade 32 has a shank 34 with a 'fir-tree' shape. The shank 34 is seated in a recess 36 of the disc 30, the recess 36 having a complimentary shape to the shank 34 so as the blade 32 is retained.

The shank has a bottom surface 38 that faces a base surface 40 of the recess 36. A gap exists between the bottom surface 38 and base surface 40 defining a cavity 42 therebetween. In use the cavity 42 allows cooling air to pass from the front of the shank 34 to its rear in order to cool it. Furthermore the base surface 40 has a cooling air inlet (not shown) therethrough into the body of the blade. Cooling fluid entering the body of the blade is used to cool internal and external surface of the blade via a plurality of cooling passages and holes (not shown).

In the prior art arrangement of FIGS. 2 and 3 the bottom surface 38 has a humped cross-sectional shape which remains consistent in the axial direction. This humped shape compliments the shape of the base surface 40 of the recess 36, substantially following it. In addition the bottom surface 38 maintains a consistent radial distance from the axis of rotation of the rotor arrangement throughout its axial extent. In other words the bottom surface 38 is not sloped in the axial direction.

In use cooling air passing through the cavity 42 may introduce contaminant liquid 44 such as oil into the cavity 42. The liquid 44 tends to travel radially outwards in view of strong centrifugal forces created by rotation of the rotor arrangement. The liquid 44 therefore tends to be incident on the bottom surface 38. As shown best in FIG. 2, the humped shape of the bottom surface 38 means that liquid incident on it tends to flow towards axially extending edges 46 of the bottom surface 38. Thereafter the liquid 44 may flow beyond the bottom surface 38 to pool between the shank 34 and recess 36. There the liquid 44 may increase the rate of corrosion, present a fire risk and/or give rise to out of balance forces and/or vibration which may lead to fatigue and/or fretting. Additionally the axially consistent distance of the bottom surface 38 from the axis of rotation of the gas turbine engine means that the bottom surface 38 does not favour the flow of liquid 44 towards either the front 47 or rear 48 of the disc 30. Consequently, and as best shown in FIG. 3, the direction of liquid 44 exit from the recess is unpredictable, with liquid potentially exiting both to the front 47 and rear 48 of the disc 30, requiring suitable drainage provision at both locations.

Figure 4:
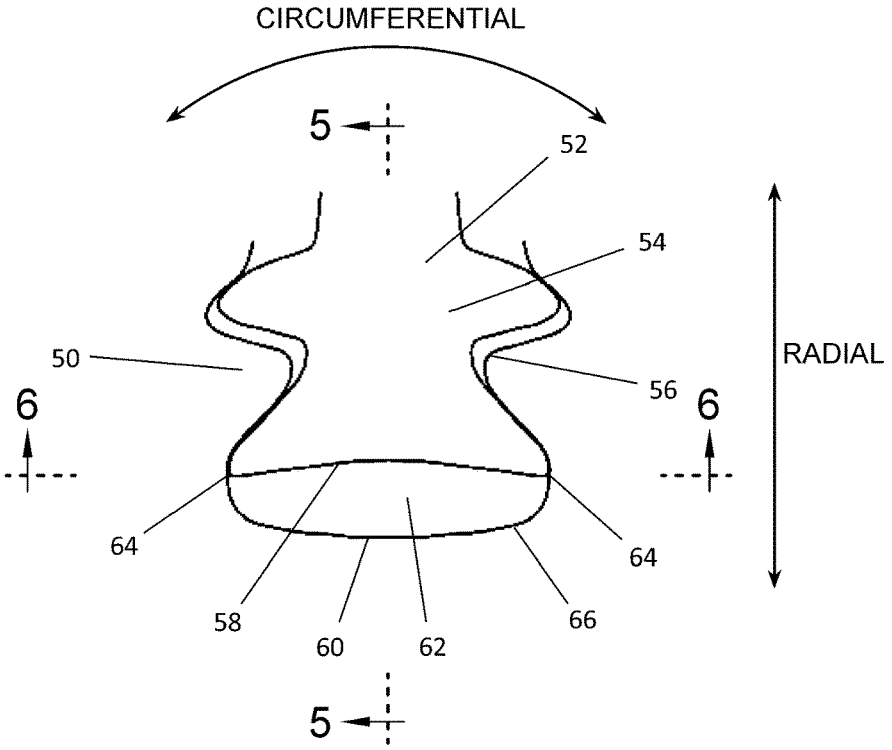
FIG. 4 is an axial cross-sectional through the shank and corresponding recess of a gas turbine engine rotor arrangement according to an embodiment of the invention.
Figure 5:
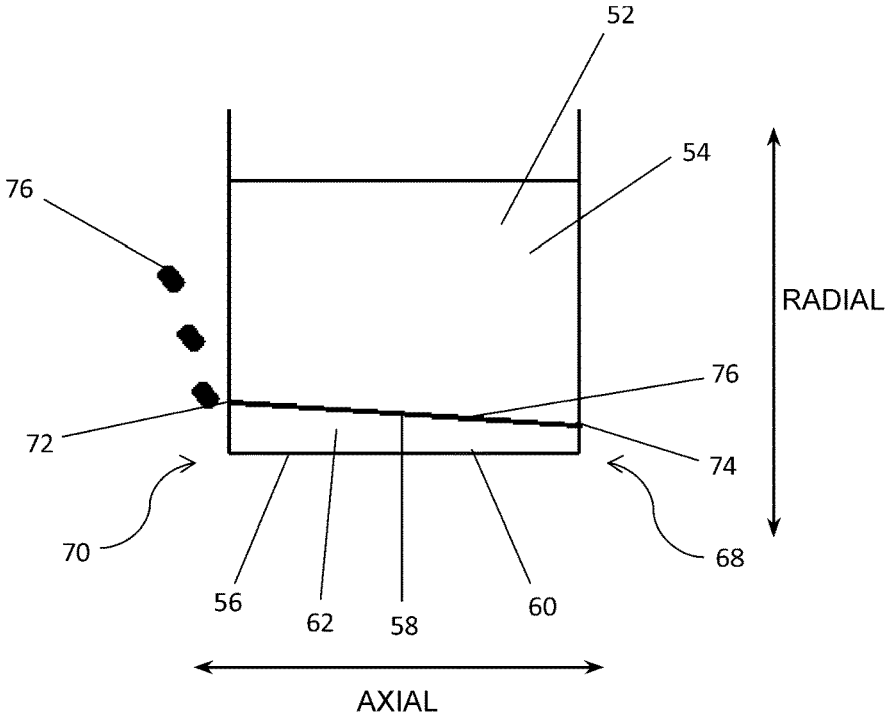
FIG. 5 is a radial cross-section through the shank and corresponding recess of FIG. 4.

Referring now to FIGS. 4 and 5 an alternative to the prior art rotor arrangement is illustrated, with part of a disc 50 and blade 52 shown. The blade 52 has a shank 54 with a 'fir-tree' shape. The shank 54 is seated in a recess 56 of the disc 50, the recess 56 having a complimentary shape to the shank 54 so as the blade 52 is retained.

The shank 54 has a bottom surface 58 that faces a base surface 60 of the recess 56. The bottom surface 58 is the radially innermost surface of the shank 54. A gap exists between the bottom surface 58 and base surface 60 defining a cavity 62 (or bucket groove) therebetween. In use the cavity 62 allows cooling air to pass from the front of the shank 54 to its rear in order to cool it.

The bottom surface 58 has a channeled cross-sectional shape, with the cross-sectional shape and size remaining consistent in the axial direction. Consequently, at any axial position, axially extending peripheral edges 64 of the bottom surface are nearer to the rotational axis of the rotor arrangement than the centre of the bottom surface 58, with a smooth contoured surface provided between the axial edges 64. The axial edges 64 of the bottom surface 58 extend between the front and rear of the disc 50 and meet a wall 66 of the recess 56 along their lengths.

The bottom surface 68 has a slope of approximately 2° from horizontal in the axial direction. The direction of the slope is such that the radial distance of the bottom surface 58 from the axis of rotation of the rotor arrangement increases from the rear 68 to the front 70 of the disc 50. Consequently a front peripheral circumferentially extending edge 72 of the bottom surface 58 has a greater radial distance from the axis of rotation of the rotor arrangement than a rear peripheral circumferentially extending edge 74. The circumferential edges 72, 74 extend between the axial edges 64, one at the front 70 and one at the rear 68 of the disc 50.

In use cooling air passing through the cavity 62 may introduce contaminant liquid 76 such as oil into the cavity 62. The liquid 76 tends to travel radially outwards in view of strong centrifugal forces created by rotation of the rotor arrangement. The liquid 76 therefore tends to be incident on the bottom surface 58. As shown best in FIG. 4, the channeled shape of the bottom surface 58 means that liquid incident on it is guided to flow between and away from the axial edges 64 (i.e. towards a circumferential centre of the bottom surface 58). This tends to prevent pooling of liquid 76 at or adjacent the axial edges 64. Furthermore, and as best seen in FIG. 5, the slope of the bottom surface 58 tends to direct liquid 76 energetically towards the front circumferential edge 72 at the bottom of the slope. This reduces liquid dwell time adjacent the bottom surface 58 and means that the axial direction of liquid exit from the cavity 62 is predictable. As a consequence of the predictability of the direction of liquid 76 exit from the cavity 62, suitable drainage need be used only at the relevant side of the disc 50 (in this case to the front 70 of the disc 50).

Figure 6:
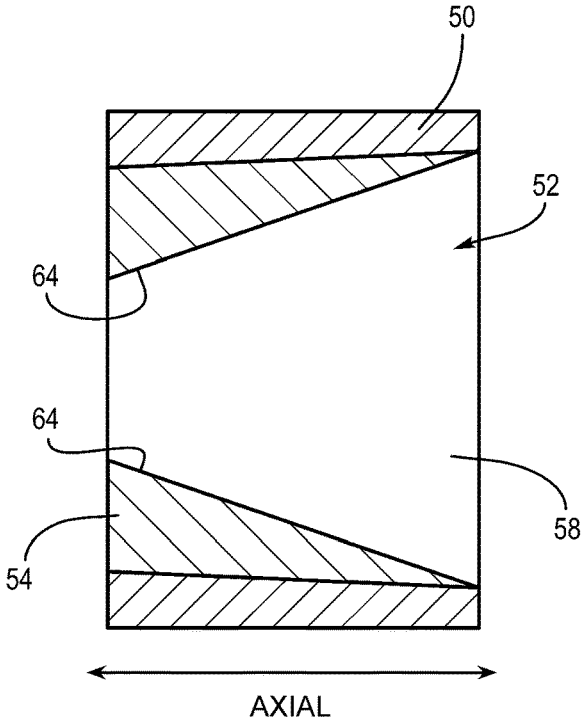
FIG. 6 is a cross-sectional view of a bottom surface of the shank taken along Line 6-6 illustrated in FIG. 3.

It will be understood that the invention is not limited to the embodiments above-described and various modifications and improvements can be made without departing from the various concepts described herein. By way of example, as shown in FIG. 6, the bottom surface might have a dished shape or at least a cross-sectional shape and/or size that varies in both the axial and radial directions, especially where a cooling fluid inlet is provided through the bottom surface. The cross-sectional shape of the bottom surface continuously changes from a front end to a rear end of the shank along the axial direction of the bottom surface. In this case the liquid might advantageously leave the cavity via the cooling fluid inlet, pass through the body of the blade, out through cooling holes and disperse in the core annulus of the gas turbine. With this embodiment there may be no need for the bottom surface to be consistently sloped in one axial direction and no need to provide liquid drainage to either side of the disc. In any case it is noted that an axial slope may not be necessary in order that the fluid exit direction from the cavity is predictable. For this, simply providing one of the circumferential edges at a different distance from the axis of rotation of the rotor arrangement to the other may be sufficient and is within the scope of the invention. Nor is the geometry of the bottom surface limited to the channelled shape shown or the dished shape described above. Alternative shapes of bottom surface (e.g. one or more substantially 'U' or 'V' shaped grooves) might also guide liquid flow between and away from the axial edges.

Except where mutually exclusive, any of the features may be employed separately or in combination with any other features and the invention extends to and includes all combinations and sub-combinations of one or more features described herein in any form of gas turbine rotor arrangement.

The invention claimed is:

1. A gas turbine engine rotor arrangement comprising:
a disc including a recess having a base surface; and
a blade having a shank securing the blade to the disc, the blade extending radially outwards from the disc, the shank of the blade being disposed in the recess of the disc, the shank including:
a bottom surface facing the base surface of the recess, the bottom surface having peripheral edges extending in an axial direction of the gas turbine rotor arrangement, the entire bottom surface having a concave shape extending in a circumferential direction and the axial direction, and facing the base surface, a cross-sectional shape of the bottom surface continuously changing from a front end to a rear end of the shank along the axial direction of the bottom surface, the bottom surface being declined in the axial direction towards a rear of the disc such that, when the engine rotor arrangement is in use, liquid located in a cavity formed by a gap between the bottom surface and the base surface, which is acted upon by an unbalanced force in a radially outward direction, is guided by the concave shape of the bottom surface to flow between the peripheral edges extending in the axial direction and away from the peripheral edges extending in the axial direction.

2. The gas turbine engine rotor arrangement according to claim 1, wherein the bottom surface meets a wall of the recess of the disc along the peripheral edges extending in the axial direction.

3. The gas turbine engine rotor arrangement according to claim 1, wherein the bottom surface is dished or channelled to direct liquid flow away from the peripheral edges extending in the axial direction.

4. The gas turbine engine rotor arrangement according to claim 1, wherein the bottom surface has peripheral circumferentially extending edges, one of the peripheral circumferentially extending edges being located at a front of the disc and another one of the peripheral circumferentially extending edges being located at the rear of the disc, the peripheral circumferentially extending edges having in use different radial distances from an axis of rotation of the rotor arrangement.

5. The gas turbine engine rotor arrangement according to claim 4, wherein the front circumferential edge has a greater radial distance from the axis of rotation of the rotor arrangement than the rear circumferential edge.

6. The gas turbine engine rotor arrangement according to claim 1, wherein the bottom surface is sloped in the axial direction.

7. The gas turbine engine rotor arrangement according to claim 6, wherein the slope is at least 1 degree.

8. The gas turbine engine rotor arrangement according to claim 6, wherein the bottom surface slopes radially outwards in a direction from the rear of the disc to a front of the disc.

9. The gas turbine engine rotor arrangement according to claim 1, wherein the rotor arrangement is a turbine.

10. A gas turbine engine having the rotor arrangement in accordance with claim 1.

* * * * *